US007658264B2

(12) United States Patent
Mauthner

(10) Patent No.: US 7,658,264 B2
(45) Date of Patent: Feb. 9, 2010

(54) COMBINATION DESCENDER, PULLEY AND FORCE LIMITING ROPE BRAKE

(76) Inventor: Kirk Martin Mauthner, P.O. Box 399, 4055 Horse Thief Road, Invermere, British (CA) V0A 1K0

( * ) Notice: Subject to any disclaimer, the term of this patent is extended or adjusted under 35 U.S.C. 154(b) by 348 days.

(21) Appl. No.: 11/373,177

(22) Filed: Mar. 13, 2006

(65) Prior Publication Data

US 2006/0207829 A1 Sep. 21, 2006

Related U.S. Application Data

(60) Provisional application No. 60/661,900, filed on Mar. 16, 2005.

(51) Int. Cl.
*A62B 1/20* (2006.01)

(52) U.S. Cl. ..... 182/5; 254/391

(58) Field of Classification Search ..... 182/5; 254/391

See application file for complete search history.

(56) References Cited

U.S. PATENT DOCUMENTS 1,636,273 A * 7/1927 Baker ..... 254/391
3,756,565 A * 9/1973 Sakai ..... 254/391
3,759,346 A 9/1973 Brda
3,807,696 A 4/1974 Brda
4,934,660 A * 6/1990 Nelson ..... 254/394
5,168,958 A 12/1992 Wullimann
5,305,852 A 4/1994 Klokseth
5,348,116 A 9/1994 Pickering
5,348,117 A 9/1994 Pickering
5,360,083 A 11/1994 Hede
5,540,307 A 7/1996 Pickering
5,577,576 A 11/1996 Petzl et al.
5,615,865 A * 4/1997 Fountain ..... 254/391
5,664,640 A 9/1997 Smith
5,701,972 A 12/1997 Bloder
5,799,753 A 9/1998 Peltier
5,927,438 A 7/1999 Ostrobrod
6,189,867 B1 2/2001 O'Rourke et al.
6,742,770 B1 * 6/2004 Vassioukevitch ..... 254/391

* cited by examiner

*Primary Examiner*—Alvin C Chin-Shue
(74) *Attorney, Agent, or Firm*—Anthony C. Edwards

(57) ABSTRACT

A combination descender, pulley, and force limiting rope brake for rope rescue has a supporting plate having a one-way pulley sheave rotatably mounted thereto for free-wheeling rotation of the sheave in only a first rotational direction. A fixed brake member is mounted rigidly to the supporting plate. A movable brake member is pivotally mounted to the supporting plate. A pinching opening is defined by the gap. The rope passes in a first direction through the gap when the sheave is free-wheeling in the first rotational direction. The movable brake member translates relative to the fixed brake member in cooperation with rotation of the sheave. Rotation-under-load of the sheave in an opposite rotational direction urges translation of the movable brake member towards the fixed brake member from an open position, wherein the pinching opening is open sufficiently to allow the rope to freely pass therethrough, to a closed position wherein the movable brake member closes the pinching opening so as to frictionally pinch the rope at a preset minimum opening of the pinching opening.

17 Claims, 9 Drawing Sheets

COMBINATION DESCENDER, PULLEY AND FORCE LIMITING ROPE BRAKE

CROSS REFERENCE TO RELATED APPLICATION

This application claims priority from U.S. Provisional Patent Application No. 60/661,900 filed Mar. 16, 2005 entitled Combination Descender, Pulley and Force Limiting Rope Brake.

BACKGROUND OF THE INVENTION

Rope rescue is essentially an access and transportation issue of moving a subject or patient from a place of predicament to a place of care. Ropes are used to raise, lower, and even horizontally move a patient and/or rescue attendant. This is accomplished with the use of variable-friction descent control devices, mechanical advantage systems such as pulley systems, rope grabs, brake or hitch devices, and back-up devices such as force limiting rope brakes. However, no prior art device of which Applicant is aware can perform the combined functions of variable friction descent control, efficient pulley with a built-in ratchet, and a belay device capable of handling rescue-sized loads, in one simple device.

Conventionally, to convert from a lower to a raise usually requires a series of steps to accomplish. First, in order to remove the descent control device, the rope is held with some form of rope grab, such as a brake, gripping hitch or mechanical rope grab. Once the descent control device is removed, rescuers may then build a pulley system, either made out of the mainline itself, or a separate pre-rigged pulley system is attached to the mainline. The pulley system usually remains on top of the cliff, building or structure, above the patient, where it is within a practical working distance of the rescuers. In order to completely raise the load to the top, multiple 'resets' of the pulley system are required. To reset the pulley system, the mainline has some form of a rope grab, often called a "ratchet" or "progress capture device", usually positioned at the first anchor pulley where the descent control device was mounted.

In addition to the mainline, a common practice in rope rescue is to also incorporate a separately anchored, un-tensioned back-up rope, often called a "belay" or "safety" line, which is intended to catch the falling load should anything inadvertently happen to any component within the mainline system. Again, this line is typically managed with specialized force-limiting rope grabs. This device must be capable of easily taking in or letting out rope as the load is being raised or lowered, and must be able to withstand a shock force and quickly arrest the falling load should anything within the mainline system fail. Thus it may be seen that, conventionally, multiple tasks and equipment are needed to change over from a lower to a raise, or from a raise to a lower, and to manage a belay/safety line.

A number of devices can accomplish both lowering and raising, such as mechanical winches. Related to winches are capstan-style drums that allow the drum to rotate one direction (while raising), but not the other, so that lowering can be accomplished by placing multiple wraps around the capstan for friction. Some products also incorporate a cam cleat to serve as a 'ratchet' so that a pulley system may be rigged utilizing the same device. But rope rescue winches and related capstan-style drums are large, heavy and generally quite expensive, and are not used to also manage the belay/safety line.

Other conventional devices may be used to lower or rappel with, and may hold the mainline like a ratchet, but in Applicant's experience these devices are not rated for rescue-sized loads. These devices cannot efficiently be used as a pulley in a haul system since their internal 'pulley' does not 'freewheel' while the load is being raised. They can be used as for belay, but only for one-person loads, and are very specific to a narrow range of rope diameters.

SUMMARY OF THE INVENTION

In summary, the combination descender, pulley, and force limiting rope brake for rope rescue according to the present invention includes first and second plates, where the first plate may be a base plate, and the second plate may be a front or cover plate generally parallel to the first plate. A one-way pulley sheave or like one-way rotatable rope carriage mechanism (collectively referred to herein as a sheave) is rotatably mounted to the first plate for free-wheeling rotation in only a first rotational direction. In one embodiment not intended to be limiting, the pulley or rope carriage mechanism is sized to receive half a turn of rope around the pulley or mechanism, for example generally near one end of the rope closest to a load on the rope.

The sheave is sandwiched between the first and second plates when the first and second plates are mounted to one another so as to define a rope passageway extending from an entry on a first side of said sheave, around an upper side of said sheave, to a pinching opening defined between a fixed member and a movable member.

The fixed member is rigidly mounted between said plates and may be rigidly mounted to said first plate, to create one part of the rope pinching mechanism. The movable member is mounted so as to translate relative to said fixed member in cooperation with rotation of said sheave, wherein rotation-under load of said sheave in said first rotational direction urges translation, by a translation linkage, of said movable member towards said fixed member from an open position, wherein said pinching opening allows the rope to freely pass therethrough, to a closed position wherein said movable member closes said pinching opening so as to frictionally pinch or clamp the rope between a preset minimum opening. In said closed position said movable member or translation linkage engages a stop to limit translation of said movable member beyond said minimum opening towards said fixed member. Said minimum opening is sized to allow slippage of the rope under shock loading above a maximum safe rope loading limit.

The translation linkage may be at least one swing arm pivotally mounted on an axis of rotation common to said sheave. A resilient biasing means, such as a spring, may be mounted to said first plate to resiliently bias said at least one swing arm and movable member into said open position. In one embodiment the spring includes two torsion springs, one placed inside the other, where one spring biases the translation link to a "rope-locked" or closed position of the pinching opening, and the other spring will bias the translation link to the "open" position, so that in the absence of a load on the rope the device can be used as a belay device so that rope can be easily let out or taken in. The user selects the position of the spring for example by turning a knob, when using the device to lower loads or when using the device as a ratchet pulley. If the device is then shock loaded by a shock load on the rope, the friction around the sheave will cause the translation of the translation link to the closed position to lock the rope, against the return biasing of the torsion spring acting on it. Two levels of torsion spring resistance, dependent on the stiffness and diameter of rope being used, can be selected by the operator for this belay mode. Thus, in the absence of the load on the rope above a preset rope loading, the pinching opening remains substantially in said open position allowing free passage of the rope through the rope passageway in said free-wheeling first rotational direction of said sheave. Upon a rope loading above said preset rope loading; said movable member is urged to close said pinching opening into said closed position against the return biasing force of said resilient biasing means.

When said movable member is in said closed position, friction applied to the rope by the pinching of the rope in the pinching opening between said fixed member and said movable member may be selectively adjusted by a friction adjustment means. In one embodiment, said friction adjustment means may include a manually actuable incremental release linkage cooperating with said translation linkage, wherein manual actuation of said incremental release linkage selectively and incrementally forcefully translates said movable member away from or closer to said fixed member so as to adjust friction on the rope passing through said pinching opening. In one embodiment not intended to be limiting, an actuating handle such as a knob is rotatably mounted to said first plate so as to engage, in intermeshing engagement, a first gear on said handle with a second gear mounted to said at least one swing arm. Thus rotation of said handle rotates said first gear, thereby actuating said second gear to cause incremental translation of said movable member mounted on said at least one swing arm.

In a preferred embodiment, said first gear is a first gear sector so that over-rotation of said handle causes corresponding over-rotation of said first gear sector thereby releasing said first gear from said engagement with said second gear, whereby over-riding manual actuation of said movable member is released. In one embodiment said first gear is a pinion gear or a sector thereof, and said second gear is a second gear sector having an axis of rotation common to said at least one swing arm.

DETAILED DESCRIPTION OF EMBODIMENTS OF THE INVENTION

Figure 1:
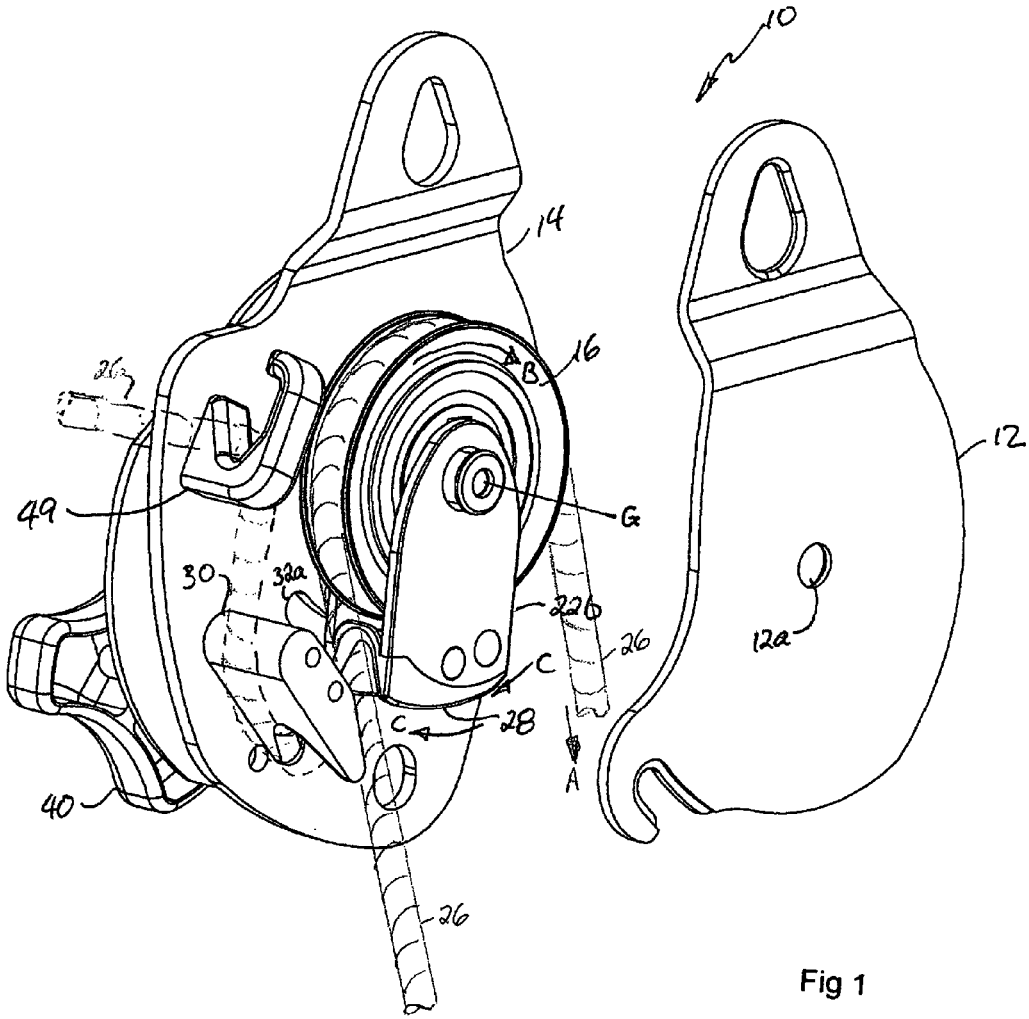
FIG. 1 is, in partially exploded partially cut away front right perspective view, the combination descender, pulley and force limiting rope brake according to the present invention.
Figure 2:
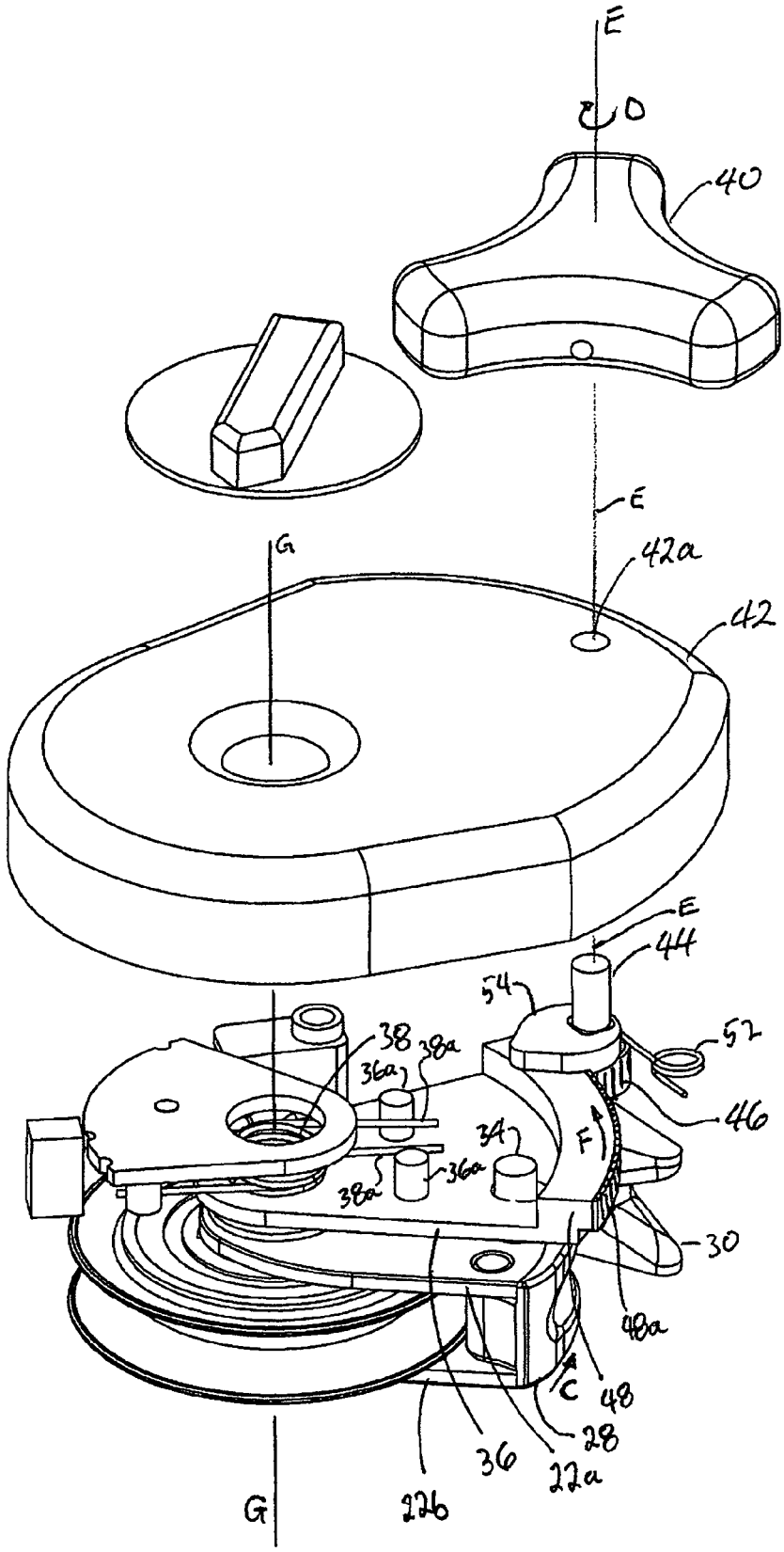
FIG. 2 is, in partially cut away partially exploded left front perspective view, the device of FIG. 1.
Figure 3:
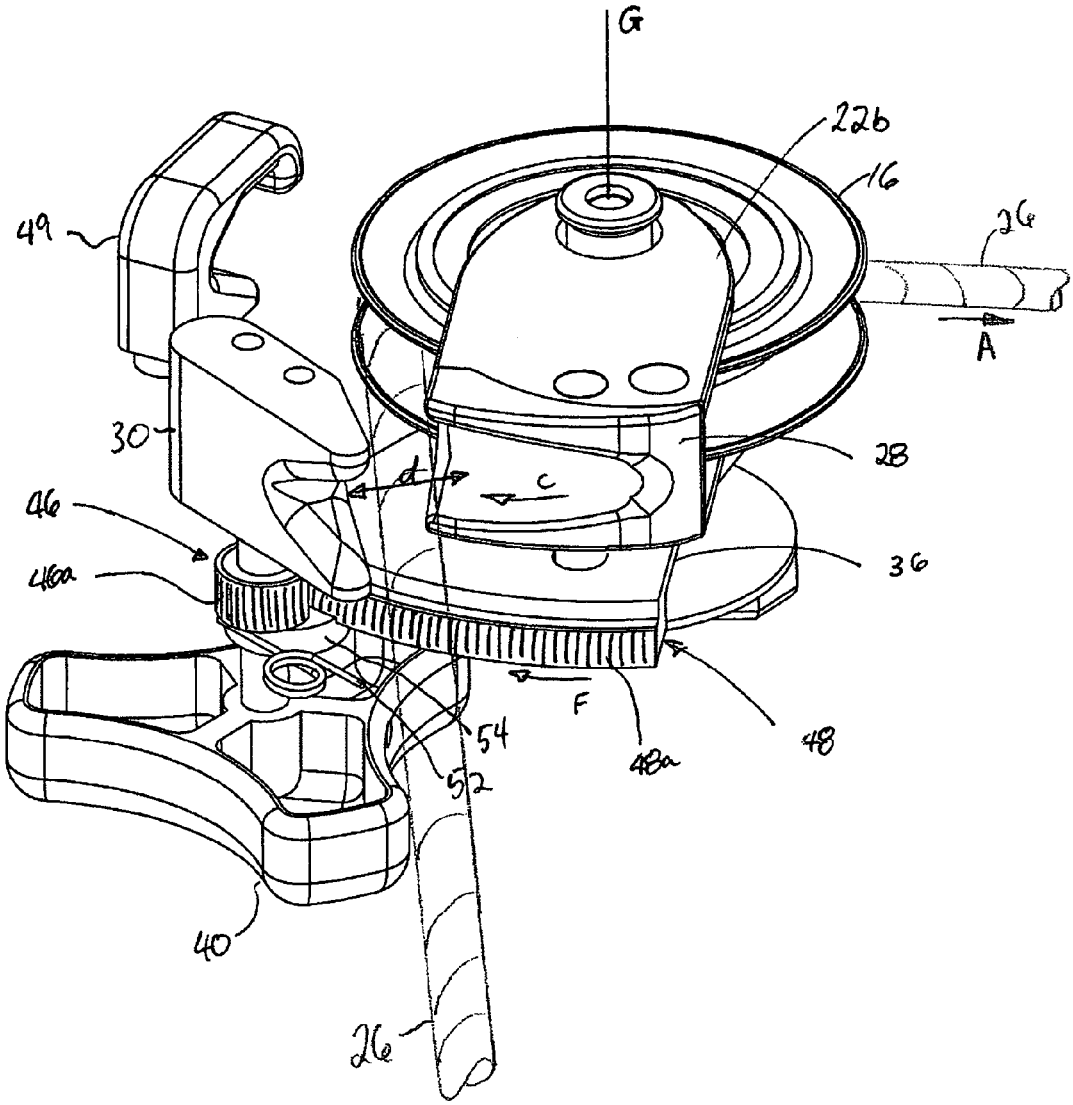
FIG. 3 is, in partially cut away bottom right perspective view, the device of FIG. 1.
Figure 4:
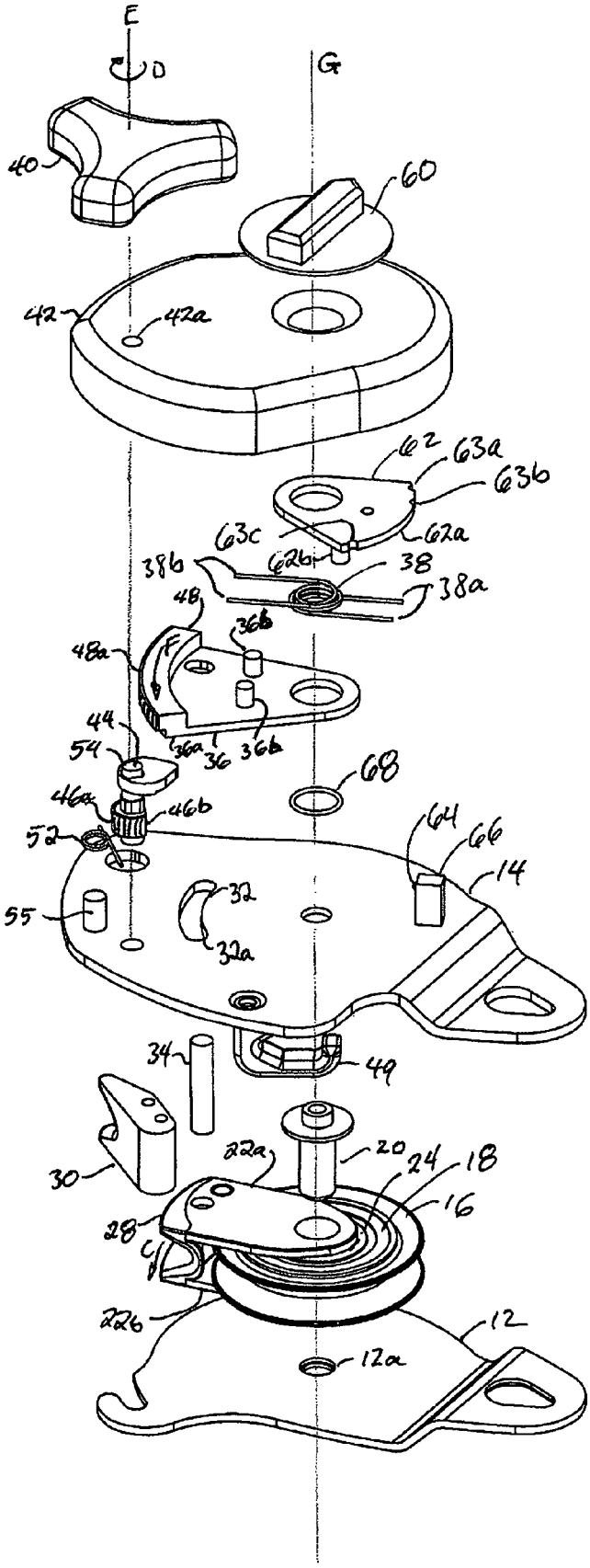
FIG. 4 is, in exploded left front perspective view, the device of FIG. 1.
Figure 5:
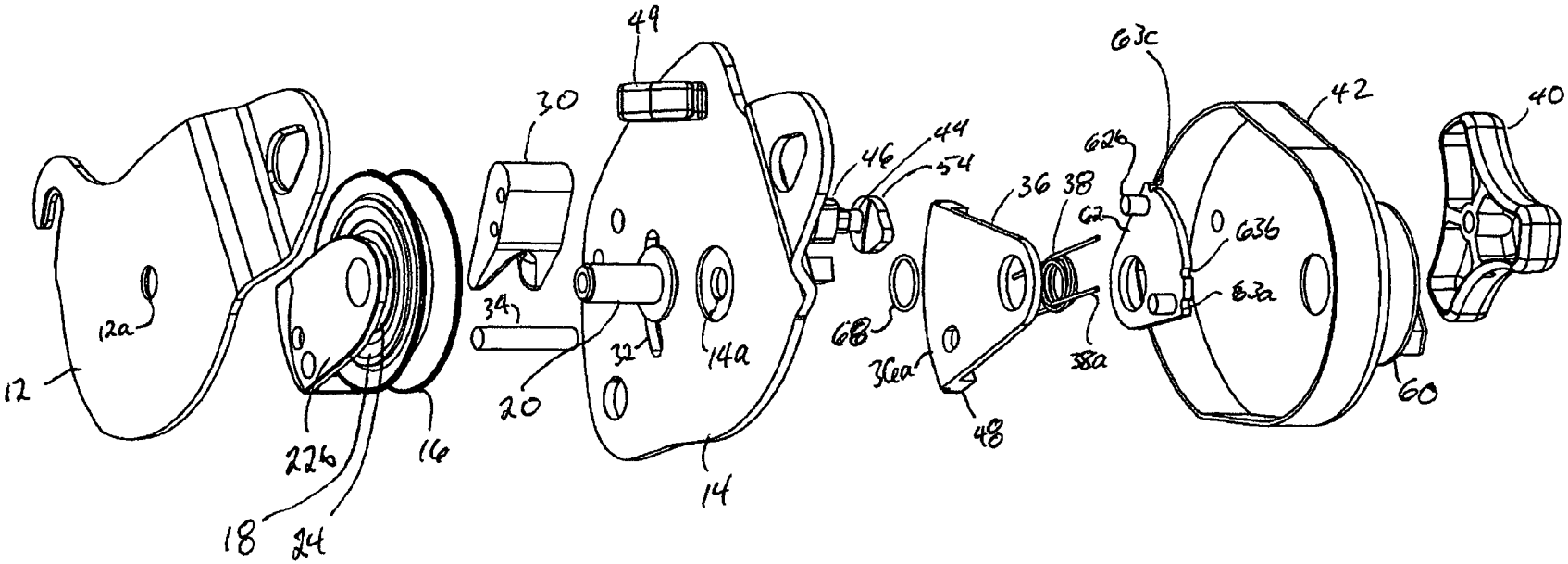
FIG. 5 is, in exploded right rear perspective view, the device of FIG. 1.
Figure 6:
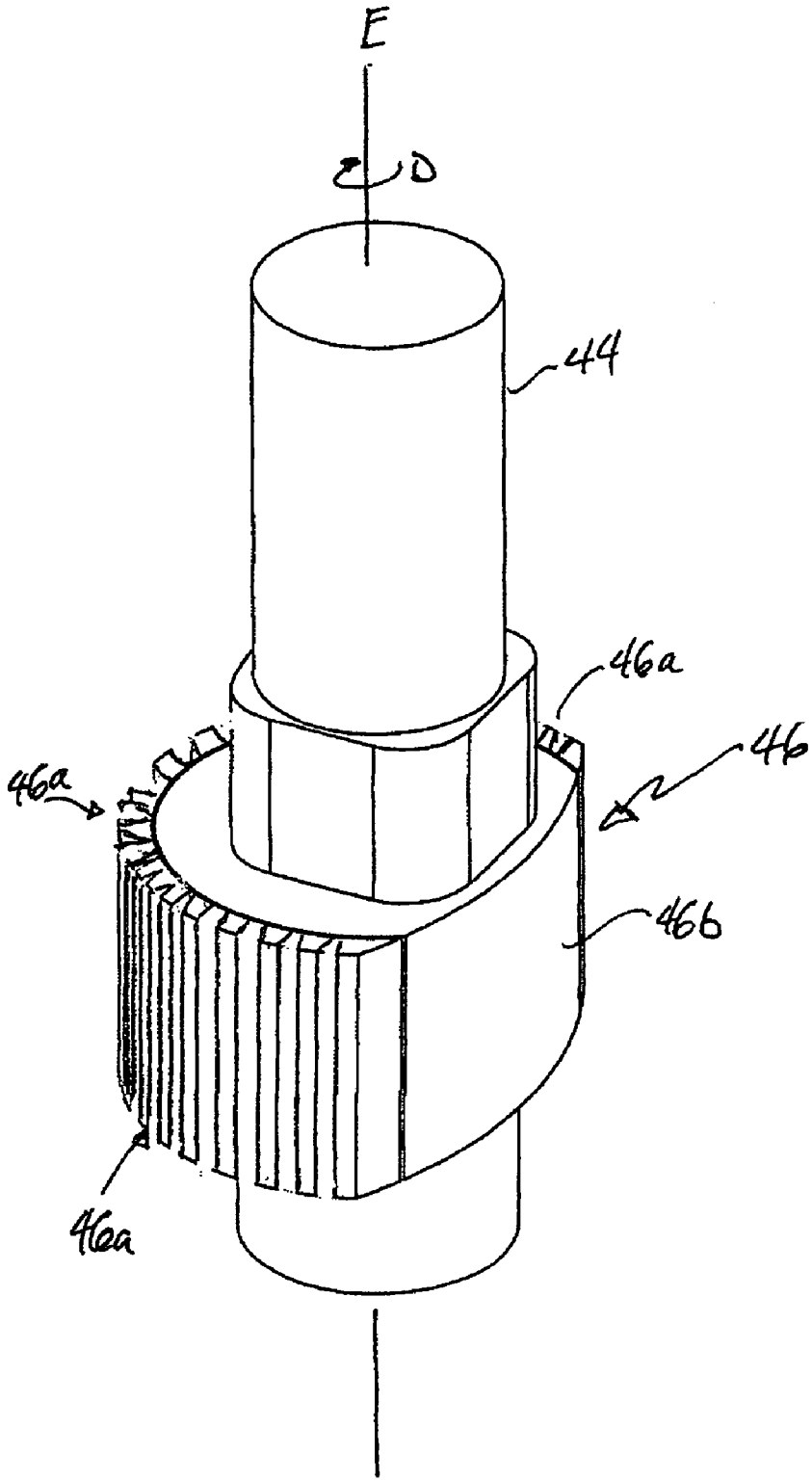
FIG. 6 is, in perspective view, a clipped pinion gear of the device of FIG. 1.
Figure 7:
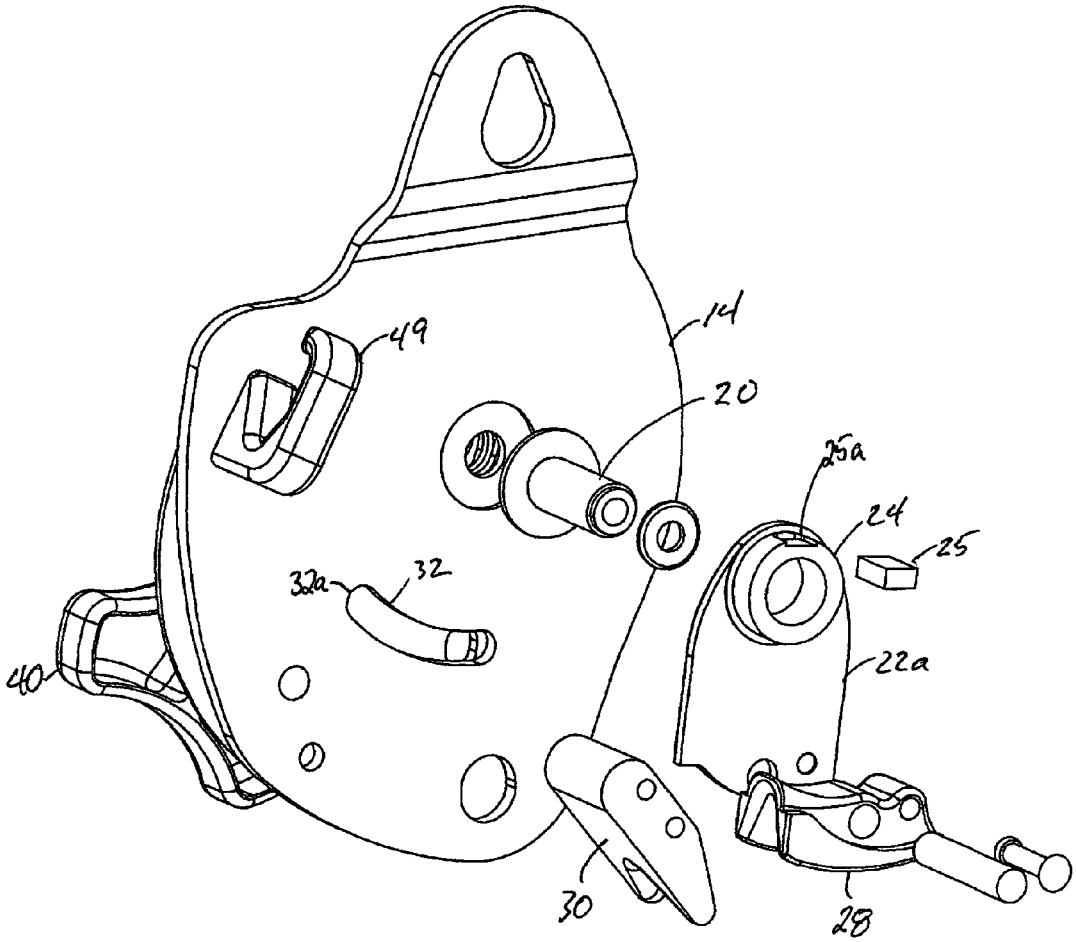
FIG. 7 is, in partially cut away partially exploded front right perspective view, the device of FIG. 1.
Figure 8:
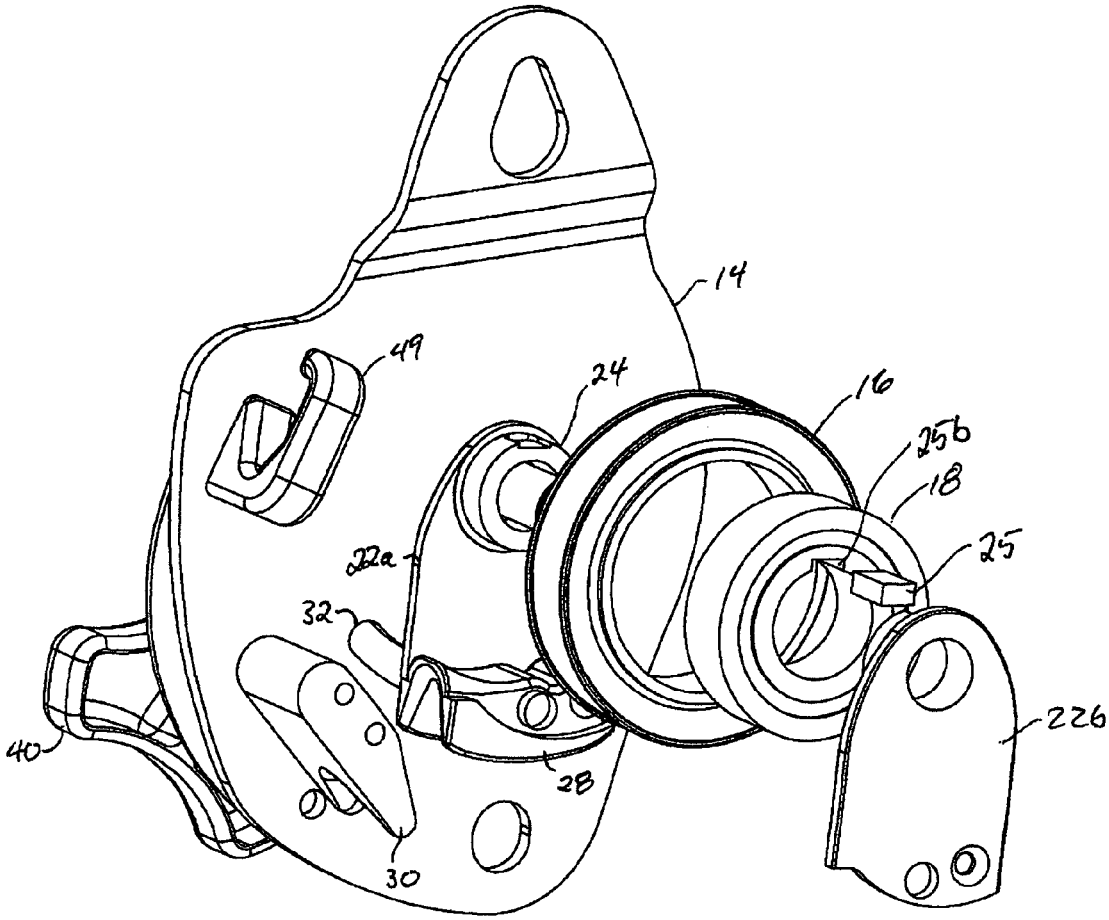
FIG. 8 is, in partially cut away partially exploded front right elevation, view, the device of FIG. 1.
Figure 9A:
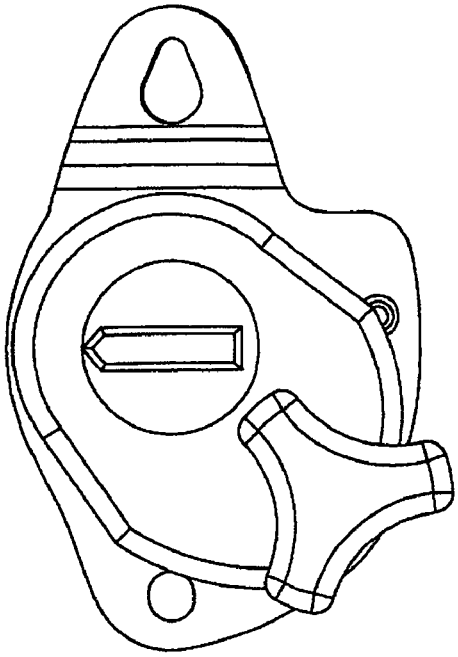
FIG. 9*a* is, in left side elevation view, the device of FIG. 1.
Figure 9B:
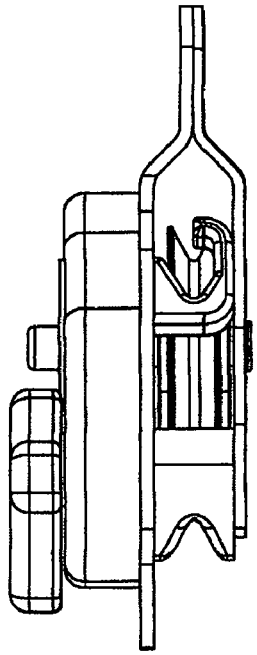
FIG. 9*b* is, in front elevation view, the device of FIG. 1.
Figure 9C:
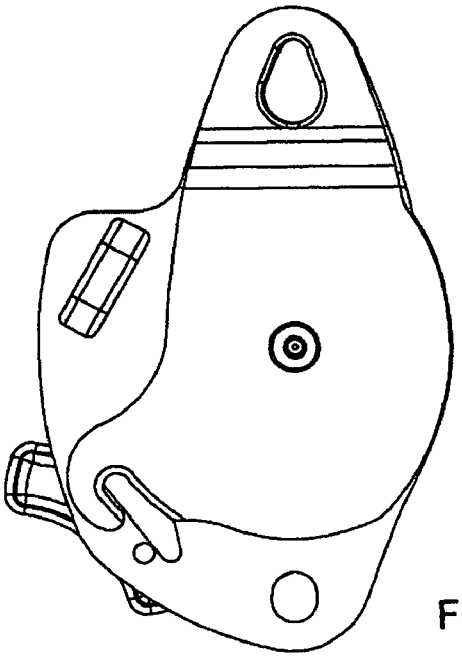
FIG. 9*c* is, in right side elevation view, the device of FIG. 1.
Figure 9D:
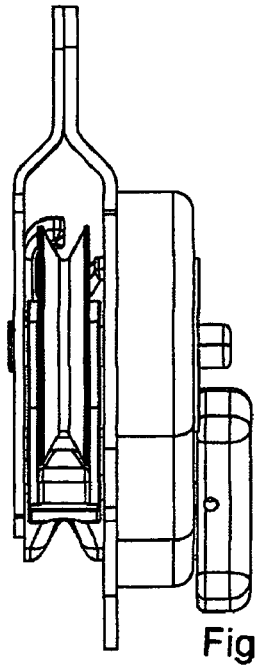
FIG. 9*d* is, in rear elevation view, the device of FIG. 1.

The device of the present invention combines the capabilities of, firstly, a variable friction descent control device usable for either lowering rescue-sized loads or rappelling, with, secondly, a ratchet-function pulley, and, thirdly, a force limiting rope brake suitable for belaying rescue-sized loads. The device is adapted to accept a range of rescue rope diameters, is relatively lightweight, and is intended both to reduce the complexity associated with changeovers from lowering to raising and to minimize specialization of equipment between mainline and belay lines. The device in one embodiment may be loaded onto a length of rope anywhere along the length of the rope, rather than merely from the end of the rope as in the prior art.

As seen in the accompanying Figures wherein corresponding reference numerals denote corresponding parts in each view, within device 10 generally parallel front and back plates 12 and 14 respectively provide a primary framework supporting, and sandwiched therebetween, a sheave 16 rotatably mounted for unidirectional rotation on a one-way bearing 18 such as a so-called sprag bearing or clutch, bearing 18 mounted onto hub 24. In an alternative embodiment, a ratchet and pawl mechanism may be used in place of a one-way bearing. Sheave 16 in the illustrated embodiment is a press-fit onto bearing 18, and bearing 18 is locked into place relative to hub 24 by key 25 fitting into keyways 25*a* and 25*b*. Hub 24 is mounted onto a main axle 20. Main axle 20 is itself journalled through apertures 12*a* and 14*a* respectively in front plate 12 and back plate 14.

The ratchet function is activated by a pair of connecting swing arms or brake-cam arms 22*a* and 22*b* mounted to, so as to extend from hub 24. In one embodiment, the pulley sheave profile of sheave 16 is sized to accept a half-wrap of rope 26 placed around it. When a load is applied in direction A to the rope, it applies sufficient torque to the sheave in direction B due to friction between the rope and sheave (which is not free-wheeling in direction B but rather is only free-wheeling in a direction opposite to direction B) to swing a movable brake cam 28 mounted on arms 22*a* and 22*b* in direction C so as to wedge or pinch rope 26 between movable cam 28 and a fixed brake wedge 30 mounted to, so as to be sandwiched between, front and back plates 12 and 14. This locks the rope pinched between the cam 28 and wedge 30 and prevents further slippage of the rope in direction A. However, because during a shock loading of the rope it is undesirable for the loading to exceed the load limit of the rope, the device according to the present invention provides that the rope be deliberately allowed to slip between movable cam 28 and fixed wedge 30 above a set upper load limit. Below this load limit the rope remains immovably pinched between the cam and wedge. This is accomplished by limiting the range of travel of movable brake cam 28 so that, when the cam is closest to the fixed wedge at the limit of its permitted travel, a fixed gap "d" is left between the cam and the fixed wedge. This serves as a safeguard because the rope when tensioned above the load limit is allowed to slip between the cam and fixed wedge to prevent excessive forces being exerted on the rope. For example, this is advantageous for application in belaying.

The size of gap "d" is set by the proximity of the end 32*a* of slot track 32 to wedge 30. Pin 34 travels in the arc of track 32. Pin 34 is rigidly mounted at one end to connecting arm 22*a* and at its other end rigidly to swing arm 36. Track 32 is formed in back plate 14. Back plate 14 is sandwiched between swing arm 36 and connecting arm 22*a*. Thus swing arm 36 and connecting arms 22*a* and 22*b* carrying movable cam 28 are constrained to rotate about axis of rotation G the distance of the arc of track 32.

When in a belay mode, better described below, a double-acting torsion spring 38 biases swing arm 36 and the connecting arms 22*a* and 22*b* to rotate movable cam 28 away from fixed wedge 30 (that is, opposite to direction C) to keep the movable cam a set maximum distance (set by track 32) away from the fixed wedge so that rope may be taken in or let out when no load is on the rope. This also serves to allow the device to be used as a belay device to manage the belay/safety line as a separate untensioned rope. When a sudden load is applied to the rope in direction A, the torque in direction B applied to sheave 16 by the friction between the rope and sheave overcomes the spring resistance of spring 38 thereby allowing movable cam 28 to rotate in direction C locking rope 26 between the movable cam and fixed wedge.

A manually actuable mechanical linkage and gear assembly is mounted to swing arm 36, and thus also to connecting arms 22*a* and 22*b* so that the pinching friction on rope 26 may be manually varied. Manual release knob 40 is mounted to the side gear housing 42 on pinion shaft 44 journalled through housing aperture 42*a*. A clipped pinion gear 46 is rigidly mounted to the opposite end of pinion shaft 44, opposite from release knob 40, so that pinion gear 46 is disposed within gear housing 42. Pinion gear teeth 46*a* on pinion gear 46, engage opposed facing gear teeth 48*a* on sector gear 48. Thus, rotating release knob 40 in direction D about axis of rotation E so as to also rotate pinion gear 46 in direction D, drives sector gear 48 in direction F. As sector gear 48 is rigidly mounted onto the end 36*a* of swing arm 36, when sector gear 48 is driven in direction F, swing arm 36 is rotated about its axis of rotation G, parallel to axis of rotation E, thereby driving movable brake cam 28 in direction C. Selection is made between two levels of resistance offered by the swing arm 36 to rotation in direction C by selective rotation of selector knob 60. A stiffer spring resistance is desirable for use with thicker, stiffer ropes. A less stiff resistance is desirable for use with thinner, more supple ropes. Because selector knob 60 is linked to indexing plate 62, rotation of knob 60 correspondingly rotates plate 62. The radially outermost edge 62*a* of plate 62 is thereby slid across indexing protrusion 64 protruding from rigid member 66 mounted to plate 14. Protrusion 64 releasably locks plate 62 by engaging one of three detents 63*a*, 63*b* and 63*c* in edge 62*a*. For descent control or ratchet pulley mode, detent 63*c* is releasably, resiliently locked against protrusion 64. For resistance control one of detents 63*a* or 63*b* are selected, the former for greater resistance, the latter for lesser resistance. The use of detent 63*a* applies greater pre-loaded torsion to spring 38, the use of detent 63*b* lesser. Spring 38, and in particular, its arms 38*a*, engage posts 62*b* on plate. Arms 38*b* on spring 38 engage posts 36*b* on swing arm 36. Thus selecting detents 63*a* or 63*b* will bias swing arm 36 in one direction, and selecting detent 63*c* will bias swing arm 36 in the opposite direction. The selection of one of these biasing directions will dictate the direction of movement of swing arm 36 upon release of manual control of the position of swing arm 36 by the use of knob 40 rotating clipped pinion gear 46 against gear segment 48. Thus with detents 63*a* or 63*b* selected, upon release of manual control of the size of gap "d" between the brake cam 28 and the wedge 30, spring 38 will bias swing arm 36 in a direction opposite to direction F thereby also moving brake cam 28 in a direction opposite to direction C to open or increase gap "d". Conversely, with detent 63*c* selected, upon release of manual control of the size of gap "d", spring 38 will bias swing arm 36 in direction F thereby also moving brake cam 28 in direction C to close the gap "d" to its minimum or to engage and lock rope 26. If further friction is required on rope 26, the rope may, as shown in dotted outline in FIG. 1, be additionally wrapped around post 49.

Thus an operator wishing to manually decrease the friction on a rope 26 pinched between movable cam 28 and fixed wedge 30 rotates release knob 40 in a direction opposite to direction D. This then drives sector gear 48 in a direction opposite to direction F which correspondingly rotates movable cam 28 in a direction opposite to direction C away from rope 26 and fixed wedge 30 by rotation of movable cam 28 about axis of rotation G on connecting arms 22*a* and 22*b*.

Pinion gear 46 is clipped or sectioned so as to remove teeth 46*a* across a smooth face 46*b*. Thus, as pinion gear 46 is rotated on shaft 44 about axis of rotation E, over-rotation of pinion gear 46 disengages teeth 46*a* from sector gear teeth 48*a* thereby releasing manual control over the position of movable cam 28. Torsion spring 52 is mounted so as to engage cam-shaped lobe 54. Cam-shaped lobe 54 is rigidly mounted onto shaft 44 so as to rotate with pinion gear 46. Torsion spring 52 urges lobe 54 and thus gear 46 so as to disengage teeth 46*a* from sector gear teeth 48*a*. Thus, once manual control is released by over-rotation of pinion gear 46, the pinion gear is urged into its disengaged position, that is with smooth face 46*b* facing sector gear teeth 48*a*.

Once manual control has been released, the position of movable cam 28 is governed, as described above, in the balance between the torque in direction B driving movable cam 28 against rope 26, and the return biasing force of double-acting helical spring 38 biasing in a direction opposite to direction C movable cam 28, when in belay mode, into an open position by the oppositely directed biasing of double-acting spring arms 38*a* acting on posts 36*b* thereby releasing rope 26. Thus the pinion gear attached to the release knob provides a means for pinching the rope between, and for unlocking the rope from between, the movable cam and the fixed wedge. This allows controlled variable-friction rope slippage, controllable by the user rotating the release knob.

If additional friction is desired, then the rope may also be placed around a friction post 49. If release knob 40 is 'let go', that is, released by the operator, then movable cam 28 is biased so as to once again lock the rope. Also, in the case the operator 'panics' while lowering (or rappelling) and inadvertently over-rotates the release knob, the clipped pinion gear 46 is disengaged from sector gear 48 and, once again, movable cam 28 is biased back toward fixed wedge 30 to pinch and thereby lock rope 26. The rope can be further locked by rotating the release knob in the opposite direction thereby allowing the clipped pinion gear to act on the sector gear in the opposite direction.

The present invention thus provides for rope-locking using a one-way bearing in a V-shaped sheave wherein parallel swing arms are connected to the hub of the bearing, so that a movable brake attached to the end of the swing arm, pinch or squeeze the rope between the movable brake and a fixed brake mounted on the frame to which the swing arms are pivotally mounted. The rotation of the swing arms created by rope friction around the sheave and the one-way bearing drives the swing arm to pinch or squeeze the rope.

A release mechanism using a gear segment and a partial pinion gear allows mechanical advantage to urge the swing arm to release the locked rope other prior art forms of release, such as a simple lever system, apply more mechanical advantage to the beginning and end of the effective stroke, and less in the middle (in other words, the moment changes with levers as they are swung). The partial pinion gear also allows disengagement of the gear segment to cause re-locking of the rope in case the operator "panics" and opens up the release too far. In this gear segment and pinion system the teeth are prevented from binding by the user of a compressible material (an O-ring 68 in this case) between the gear segment plate and the shaft on which the gear segment is mounted. Thus, during initial engagement, if the pinion gear teeth bind against the gear segment teeth, then the applied force allows the gear segment supporting swing arm plate to compress the O-ring, thereby creating enough clearance for the bound pinion teeth to skip past the corresponding gear segment teeth so as to allow the gear segment and pinion teeth to properly mesh.

The present invention allows the operator to physically select between either a descent control mode (or as a pulley ratchet mode) or as a belay device. The latter selection moves the swing arm into the open position, and rope-locking will only occur if the device is shock loaded. Two levels of swing arm resistance are selectable; the stiffer spring resistance is for the stiffer 12.7 mm ropes and the less stiff resistance is for the more supple 11 mm ropes. For descent control or ratchet pulley mode, the swing arm is biased with the torsion spring to rope locking. In this case, there is no need to make have two settings of resistance; it is one selection for rope locking. This mechanism is accomplished with the rotatable selector knob that is attached to the indexing plate that acts on oppositely biased, that is double-acting torsion springs. Turning the knob in one direction biases one torsion spring, de-activating the other, and visa versa. Compression spring detents acting on the indexing plate hold the knob in the respectively selected positions.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A combination descender, pulley, and force limiting rope brake for rope rescue comprising:

a first supporting plate having a one-way pulley sheave rotatably mounted thereto for free-wheeling rotation of said sheave in only a first rotational direction, a fixed brake member mounted rigidly to said first supporting plate and a movable brake member pivotally mounted to said first supporting plate, wherein said sheave and a gap between said fixed brake member and said movable brake member define a rope passageway therebetween extending from a rope entry on a first side of said sheave, around an upper side of said sheave, to a pinching opening defined by said gap wherein the rope passes in a first direction through said gap when said sheave is said free-wheeling in said first rotational direction, and wherein said movable brake member is mounted on translation means so as to translate relative to said fixed brake member in cooperation with rotation of said sheave, and wherein rotation-under-load of said sheave in a second rotational direction opposite said first rotational direction urges translation by said translation means of said movable brake member towards said fixed brake member from an open position, wherein said pinching opening is open sufficiently to allow the rope to freely pass therethrough, to a closed position wherein said movable brake member closes said pinching opening so as to frictionally pinch the rope at a preset minimum opening of said pinching opening, and wherein said preset minimum opening is sized to allow slippage of the rope through said pinching opening under a shock loading of the rope above a maximum safe rope loading limit of the rope, wherein said translation means is at least one swine arm pivotally mounted on an axis of rotation common to said sheave, a first resilient biasing means mounted to said first plate to resiliently bias said at least one swine arm and said movable brake member into said open position so that, in the absence of a load on the rope above a preset rope loading, said pinching opening remains substantially in said open position whereby the rope may pass freely through said rope passageway in said first direction by said free-wheeling rotation of said sheave in said first rotational direction, and wherein, upon a rope loading of the rope above said preset rope loading, said movable brake member on said at least one swing arm is urged to close said pinching opening into said closed position against the return biasing force of said first resilient biasing means, a friction adjustment means wherein, when said movable brake member is in said closed position, friction applied to the rope by the pinching of the rove in said pinching opening between said fixed brake member and said movable brake member is selectively adjusted by said friction adjustment means, wherein said friction adjustment means includes a manually actuable incrementally adjustable release linkage means cooperating with said translation means, wherein manual actuation of said release linkage means selectively, incrementally, and forcefully translates said movable brake member away from or closer to said fixed brake member so as to adjust friction on the rope passing through said pinching opening, wherein said friction adjustment means includes an actuating handle rotatably mounted to said first plate, a first gear mounted to said handle, said first gear engaging, in intermeshing engagement, a second gear mounted to said at least one swing arm, wherein rotation of said actuating handle rotates said first gear thereby rotating said second gear to cause incremental translation of said movable brake member relative to said fixed brake member.

2. The apparatus of claim 1 wherein said first gear is a first gear sector so that over-rotation of said handle causes corresponding over-rotation of said first gear sector thereby releasing said first gear from said engagement with said second gear to over-ride manual actuation of said movable member, whereby said movable brake member and the pinching of the rope is released from said manual actuation and pinching respectively.

3. The apparatus of claim 2 wherein said first gear is a clipped pinion gear and said second gear is a second gear sector mounted on a supporting swing plate having an axis of rotation common to said at least one swing arm.

4. The apparatus of claim 1 wherein said first plate is a base plate and further comprising a front cover plate mountable onto, so as to be generally parallel to, said first plate to thereby house said sheave, said at least one swing arm; said fixed brake member and said movable brake member therebetween.

5. The apparatus of claim 4 wherein said at least one swing arm includes a substantially parallel pair of swing arms and wherein said movable brake member is mounted between distal ends of said pair of swing arms, distal from opposite base ends of said pair of swing arms pivotally mounted to said first plate.

6. The apparatus of claim 5 wherein in said closed position translation of said movable brake member is stopped by a stop rigidly mounted between said first and second plates to limit translation of said movable brake member to maintain said minimum opening between said movable brake member and said fixed brake member.

7. The apparatus of claim 1 wherein said first resilient biasing means is a double-acting resilient biasing means which is manually selected between a belay mode wherein, upon said release by said over-rotation of said first gear sector, said at least one swing arm is biased by said first resilient biasing means into said open position by said first resilient biasing means urging said second gear, said at least one swing arm, and said movable brake member in a gap opening direction away from said fixed brake member, and a lowering mode wherein, upon said release, said second gear, said at least one swing arm, and said movable brake member are urged in a gap closing direction towards said fixed brake member.

8. The apparatus of claim 7 wherein said first resilient biasing means includes a double-acting torsion spring.

9. The apparatus of claim 8 wherein said first gear is a clipped pinion gear and said second gear is a second gear sector mounted on a supporting swing plate having an axis of rotation common to said at least one swing arm.

10. The apparatus of claim 8 wherein said first resilient biasing means includes a selectively rotatable mode selector selectively rotating a toggle means which selectively biases said torsion spring so as to urge said at least one swing arm in said gap opening direction when in said belay mode, and biases said torsion spring so as to urge said at least one swing arm in said gap closing direction when in said lowering mode.

11. The apparatus of claim 10 wherein said toggle means includes a rotatable, manually actuable switch mounted to an indexing plate, said indexing plate rotatable substantially parallel to said supporting swing plate, said indexing plate selectively positionable between a belay mode position and at least one lowering mode position, and releasably lockable in said belay mode position and said at least one lowering mode position by a releasable latch.

12. The apparatus of claim 11 wherein said at least one lowering mode position includes a reduced resistance position wherein said torsion spring is biased in said gap closing direction with a lesser degree of resilient spring force by a reduced pre-rotation of said torsion spring by rotation of said selector to a first lowering mode position, and wherein said torsion spring is biased in said gap closing direction with a relatively greater degree of resilient spring force by a relatively increased pro-rotation of said torsion spring by rotation of said selector to a second lowering mode position, wherein said second lowering mode position is for use with thicker, stiffer rope and said first lowering mode position is for use with thinner, more supple rope.

13. The apparatus of claim 12 wherein said latch includes a protrusion mounted to said first plate engaging indexing indentations on said indexing plate.

14. The apparatus of claim 10 wherein said indexing plate and said supporting swing arm rotate about a common axis of rotation.

15. The apparatus of claim 9 wherein a second resilient biasing means is mounted so as to urge said clipped pinion gear to disengage from said second gear sector upon said release of said first gear from said second gear upon said over-rotation.

16. The apparatus of claim 9 wherein said supporting swing plate includes a resilient radial displacement means for displacement of said second gear sector in a radial direction relative to said rotation of said swing plate about its axis of rotation so as to inhibit binding of said first gear sector in said interlocking engagement with said second gear sector, wherein, upon said binding, said swing plate and said second gear sector resiliently displace radially so as to allow resilient relative re-location of said first gear sector relative to said second gear sector to re-interlock said interlocking engagement.

17. The apparatus of claim 16 wherein said resilient radial displacement means includes a resilient o-ring mounted between said swing plate and a corresponding shaft upon which said swing plate is rotatably mounted.

* * * * *